US005861807A

United States Patent [19]

Leyden et al.

[11] Patent Number: 5,861,807

[45] Date of Patent: Jan. 19, 1999

[54] SECURITY SYSTEM

[75] Inventors: Roger J. Leyden, Willow Springs; Michael A. Parent, Palatine, both of Ill.

[73] Assignee: Se-Kure Controls, Inc., Franklin Park, Ill.

[21] Appl. No.: 967,729

[22] Filed: Nov. 12, 1997

[51] Int. Cl.[6] ..... G08B 13/14

[52] U.S. Cl. ..... 340/568; 340/687; 340/691; 340/693

[58] Field of Search ..... 340/568, 571, 340/693, 687, 691

[56] References Cited

U.S. PATENT DOCUMENTS

| | | | |
|---|---|---|---|
| D. 335,439 | 5/1993 | Leyden et al. | D8/332 |
| D. 345,092 | 3/1994 | Leyden et al. | D8/332 |
| 4,620,182 | 10/1986 | Keifer | 340/568 |
| 5,146,205 | 9/1992 | Keifer et al. | 340/568 |
| 5,270,681 | 12/1993 | Jack | 340/568 X |
| 5,341,124 | 8/1994 | Leyden et al. | 340/568 |
| 5,421,667 | 6/1995 | Leyden et al. | 403/406.1 |
| 5,565,848 | 10/1996 | Leyden et al. | 340/572 |
| 5,617,073 | 4/1997 | Wilson | 340/568 |

*Primary Examiner*—Thomas J. Mullen, Jr.
*Attorney, Agent, or Firm*—Wood, Phillips, VanSanten, Clark & Mortimer

[57] ABSTRACT

A monitoring assembly has a body which is capable of being attached to an article to be monitored, a first sensor having a secured state and an unsecured state and capable of being attached to an article to be monitored, and a first elongate cord extending between the first sensor and body and having at least one conductor and a) mechanically connecting the first sensor to the body and b) defining a conductive path between the first sensor and the body. The first sensor is in the unsecured state with the conductive path between the first sensor and the body interrupted.

26 Claims, 4 Drawing Sheets

3/4
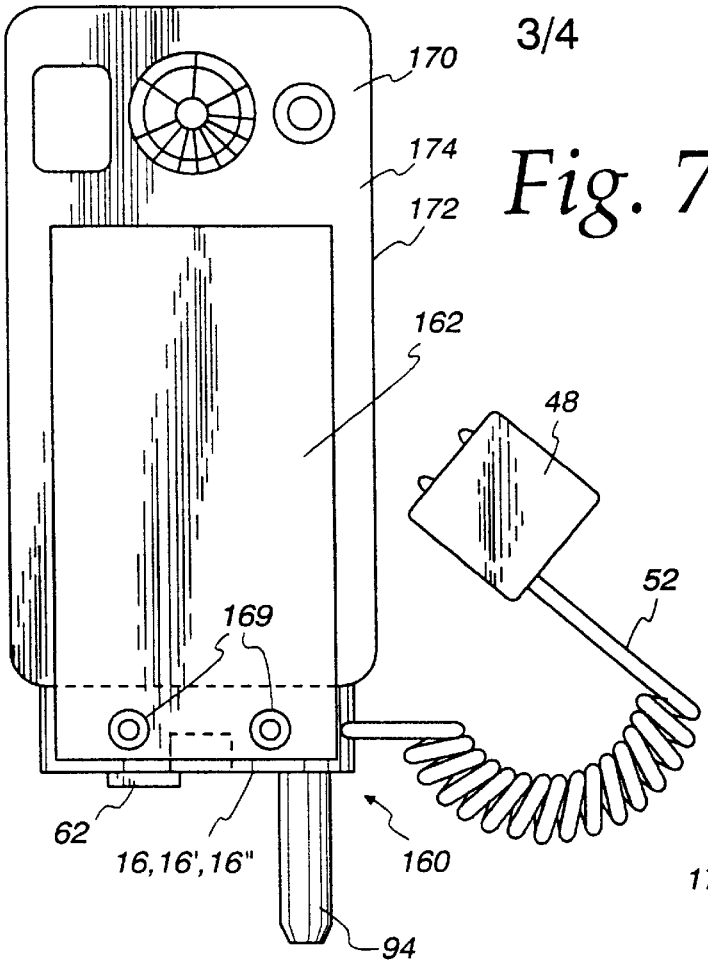
Fig. 7
Fig. 8
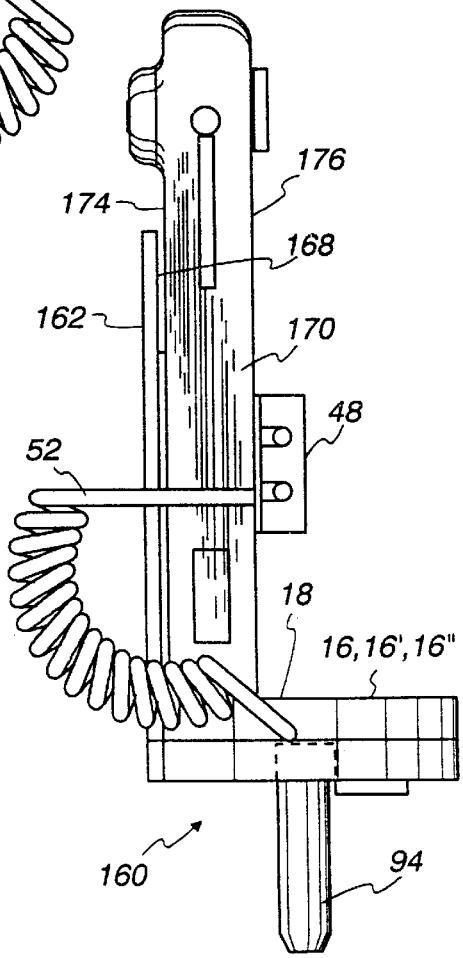
Fig. 9
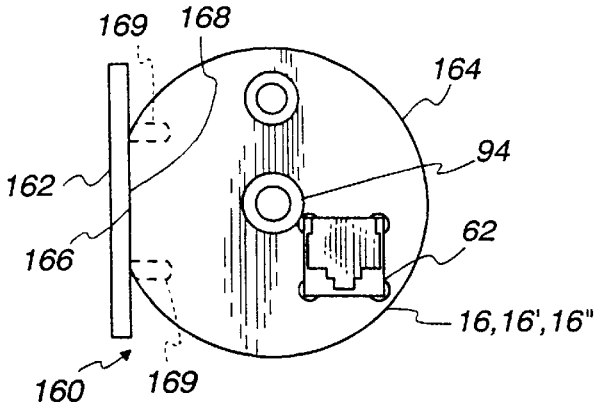

SECURITY SYSTEM

BACKGROUND OF THE INVENTION

1. Field of the Invention

This invention relates to security systems and, more particularly, to a system for preventing unauthorized removal of portable consumer articles from a specified area.

2. Background Art

Prevention of theft of merchandise is an ongoing concern of business owners. This is particularly a problem with portable electronic articles such as cameras, tape and CD players, etc. This problem is even more acute in showrooms where portable electronic articles are displayed to be handled and operated by prospective customers.

As one example, video cameras are commonly mounted in a display area and hooked up to video monitors. The prospective customer is allowed to pick up different cameras and normally operate the camera. While this display technique is effective in allowing the prospective customer to test the feel of a camera and identify its operating characteristics and features, it also offers a temptation to a would-be thief.

Heretofore, various systems have been devised to prevent unauthorized removal of such displayed articles. In U.S. Pat. No. 5,421,667, commonly assigned with this invention, a mechanical restraint system is disclosed. A rigid body is mounted to the article to be monitored and fixedly captures an end of a cable. The other cable end can be suitably anchored at the display location. While this type of system has proven highly effective, the gauge and constitution of the cable may make it prone to being severed by a sophisticated thief who is then free to remove the associated article from the premises without detection.

An electronic version of the system shown in U.S. Pat. No. 5,421,667 is disclosed in U.S. Pat. No. 5,341,124, also commonly assigned with the present invention. In the latter system, an electrically conductive path is established between the article being monitored and an apparatus for producing an audible and/or visual alarm signal. Attachment of the body to an article being monitored sets a switch to close the conductive loop. The loop is interrupted by the action of either removing the body from the article or severing the conductor/wire which defines the conductive path. This system has also been highly commercially successful.

While the latter system has been effective in preventing the unauthorized removal of consumer articles, the configuration of some articles which are being monitored introduces additional requirements. Some articles have separable parts, each of which is individually valuable. For example, digital cameras are generally constructed with a main body and a separable lens assembly. Attachment of the security system to the camera body alone leaves unprotected the lens which could be easily separated and removed from the premises without detection.

To defeat this activity, separate electrical and/or mechanical tethers could be employed, one each for the lens and camera body, and each extending back to a stationary anchoring base. In multiple camera displays, a maze of wires may result at the display area. This may introduce set up problems, potentially resulting in the improper activation of the security system. The numerous tethers may produce an unsightly appearance at the display area. Still further, the tethers may become entangled and may interfere with the inspection and operation of the article by a prospective purchaser.

SUMMARY OF THE INVENTION

In one form of the invention, a monitoring assembly has a body which is capable of being attached to an article to be monitored, a first sensor having a secured state and an unsecured state and capable of being attached to an article to be monitored, and a first elongate cord extending between the first sensor and body and having at least one conductor and a) mechanically connecting the first sensor to the body and b) defining a conductive path between the first sensor and the body. The first sensor is in the unsecured state with the conductive path between the first sensor and the body interrupted.

A bolt may be used to attach the body to an article to be monitored. In one form, the body has a substantially flat mounting surface and there is an opening extending through the mounting surface to accept the mounting bolt.

A mounting pin may be fixedly attached to the body to project in cantilever fashion therefrom.

The first sensor may have a housing with a light emitting element on the housing that is illuminated with the first sensor in one of the secured and unsecured states.

The body may have a second surface that is substantially flat and faces oppositely to the mounting surface with there being one piece that may define both the mounting and second surfaces.

A connector may be provided on the body to releasably connect to a connector on the second elongate cord to allow the second elongate cord to establish a conductive path between the at least one conductor and a control unit for monitoring the state of the first sensor.

In one form, the connector on the body is a phone jack.

The first sensor may have a switch thereon that is changeable between a first state and a second state, with the first sensor changing from the secured state into the unsecured state as an incident of the switch changing from the first state into the second state. The first sensor has a wall that is capable of being operatively attached to a first element to be monitored such that with the wall operatively attached to the first element to be monitored, the switch is maintained in the first state.

A second sensor may be provided and has a secured state and an unsecured state. The second sensor is capable of being attached to an article being monitored. A second elongate cord extends between the second sensor and body and has at least one conductor and a) mechanically connects the second sensor to the body and b) defines a conductive path between the second sensor and the body. The second sensor is in the unsecured state with the conductive path between the second sensor and the body interrupted.

An additional elongate cord can be provided with there being cooperating connectors on the body and additional elongate cords which can be coupled by press fitting to establish a conductive path, through the additional cord, between the at least one conductor and a control unit for monitoring the state of the first sensor.

In one form, the body defines first and second substantially flat transverse mounting surfaces for an article to be monitored.

The invention also contemplates the combination of a) an article to be monitored and b) a monitoring assembly. The monitoring assembly has a body, a fastener rigidly attaching the body to the article, a first sensor having a secured state and an unsecured state and attached to the article, and a first elongate cord extending between the first sensor and body and having at least one conductor and a) mechanically connecting the first sensor to the body and b) defining a conductive path between the first sensor and the body. The first sensor is in the unsecured state with the conductive path between the first sensor and the body interrupted.

In one form, the article has first and second separable elements, with the monitoring assembly having a second sensor similar to the first sensor, with the first sensor attached to the first element and the second sensor attached to the second element.

The combination may further include a control unit for monitoring the state of the first sensor.

The article may be a camera or other portable article.

The invention further contemplates a monitoring assembly having a body which is capable of being attached to an article to be monitored, a first sensor capable of being attached to an article to be monitored, and a first elongate cord extending between the first sensor and body and mechanically connecting the first sensor to the body.

BRIEF DESCRIPTION OF THE DRAWINGS

FIG. 7 is a front elevation view of a modified form of monitoring assembly, according to the present invention, with a body thereon operatively attached to a camera and with a sensor unattached to the camera;

FIG. 8 is a side elevation view of the monitoring assembly of FIG. 7 with the sensor attached to the camera;

DETAILED DESCRIPTION OF THE DRAWINGS

Figure 1:
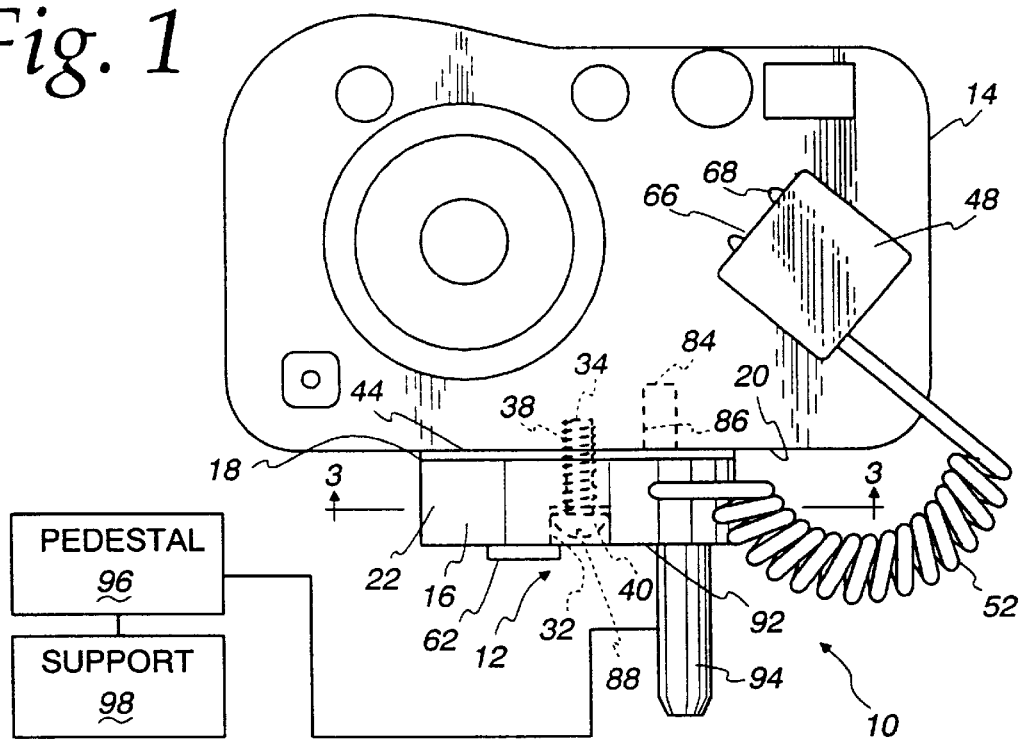
FIG. 1 is a side elevation view of a monitoring system with a monitoring assembly, according to the present invention, operatively connected to a digital camera.
Figure 2:
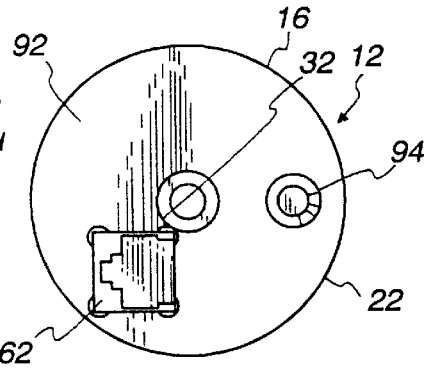
FIG. 2 is a bottom view of a body on the mounting assembly of FIG. 1 that is directly attached to the camera.
Figure 3:
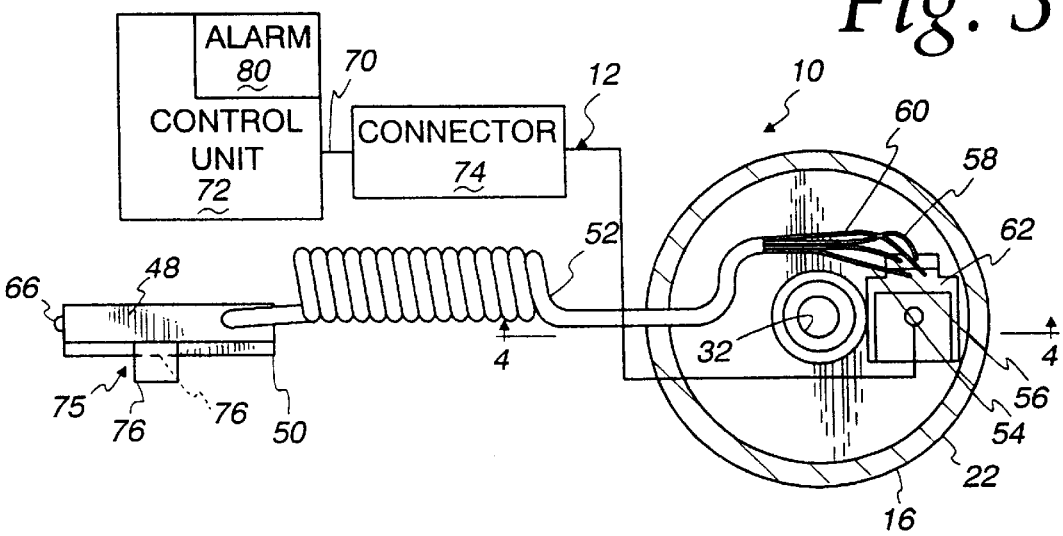
FIG. 3 is a partially schematic representation of the monitoring system of FIG. 1 and showing an enlarged, cross-sectional view of the body taken along line 3—3 of FIG. 1 with a cord and sensor operatively connected thereto.

Referring initially to FIGS. 1–4, one form of monitoring system, according to the present invention, is shown at 10. The monitoring system 10 includes a mounting assembly 12 which is operatively connected to an article to be monitored, in this case a handle holdable digital camera 14. The inventive concept can be used to monitor virtually any type of portable consumer article.

The, mounting assembly 12 consists of a disk-shaped body 16 having a flat mounting surface 18 which can be facially abutted to a flat surface 20 on the bottom of the camera 14. In this particular embodiment, the body 16 has a cup-shaped portion 22 with a stepped, outer rim 24 which seats a flat disk 26 that defines the mounting surface 18 in conjunction with an outer edge 28 of the rim 24. A central boss 30 defines a stepped through bore 32 to accept a mounting bolt 34. A bore 36 in the disk 26 is coaxial with the through bore 32.

The bolt 34 preferably is of a size and thread to mate within a blind bore 38 in the camera 14 that accommodates a conventional tripod bolt (not shown). The bolt 34 is directed through the bores 32, 36 and into the camera bore 38. The enlarged head 40 of the mounting bolt 34 abuts to a recessed shoulder 42 on the boss 30. By tightening the bolt 34 into the camera bore 38, the body 16 is borne positively against the camera surface 20 to thereby rigidly mount the body 16 on the camera 14 so that the body 16 and camera 14 are movable as one piece.

Optionally, a thin rubber sheet 44 is interposed between the body mounting surface 18 and the camera surface 20. With the body 16 drawn positively against the camera 14, the sheet 44 compresses slightly to thereby increase the coefficient of friction between the rubber sheet and each of the camera surface 20 and the body surface 18. At the same time, the sheet 44 prevents scratching of the camera surface 20 by the body 16.

A sensor 48 is attached to the camera 14 using a double-sided adhesive layer 50. The sensor 48 is mechanically connected to the body 16 through an elongate, flexible cord 52, which in this case has four conductors/wires 54, 56, 58, 60 which define conductive paths between the sensor 48 and a connector 62 on the body 16. The sensor 48 has a housing 64 to which are mounted first and second light emitting diodes (LED's) 66, 68 which are electrically connected to the conductors 56, 58.

Through a separate elongate cord 70, conductive paths between the conductors 54, 56, 58, 60 on the body 16 and a control unit 72 are established. To electrically couple the cord 70 to the cord 52, phone jack connectors are used. In this case, the connector 62 is a female phone jack with a male phone jack/connector 74 being attached to the elongate cord 70. The cord 52 is attached to the housing 64 so that the conductors/wires 54, 56, 58, 60 are in fixed relationship to each other at the housing 64. The connectors 62, 74 can be releasably, electrically coupled by a press fit step. With this arrangement, the body 16 can be pre-attached to the camera 14 after which the connector 74 can be press fit into the connector 62.

On the sensor housing 64, a switch 75 is mounted. The switch 75 includes a movable element depressible button 76 which is normally spring biased to the solid line position in FIG. 3. The button 76 is depressible to the dotted line position in FIG. 3 against the spring bias force. The details of operation of all of the circuitry heretofore generally described are set out fully in U.S. Pat. No. 5,341,124, which is incorporated herein by reference. It suffices to say that the sensor 48 has a secured electrical state and an unsecured electrical state. In the secured state, the button 76 is depressed to a first state, which is sensed by the control unit 72 through the conductive paths between the sensor 48 and the control unit 72, so long as these paths are interrupted. In an exemplary system configuration, with the sensor 48 attached to the camera 14, the captive button 76 becomes depressed. In response, the control unit 72 causes illumination of one of the LED's 66. In the event that the sensor 48 is removed from the camera 14 so that the button 76 springs out to the solid line position of FIG. 3, or one of the cords 52, 70 is severed, there is an interruption in one of the conductive paths which is sensed by the control unit 72 and causes an audible or visual alarm signal to be produced. The control unit 72 may include an alarm 80 which is triggered by this tampering. The other LED 68 may illuminate to indicate that there has been a breach in the security. In more sophisticated versions, the control unit 72 may cause the light 68 to blink even if the button 76 is depressed after the sensor 48 is removed from the camera 14.

The body 16 may also include a locating pin 84 which projects into a blind bore 86 in the camera 14, which bore 86 is conventionally radially offset from the bore 38. This arrangement prevents rotation of the body 16 as might allow its unauthorized release. Typically, the head 40 of the mounting bolt 34 has a fitting 88 to accommodate a special tool so as to prevent tampering. By preventing rotation of the body 16, turning of the bolt 34 by manipulation of the body 16 is prevented.

The body 16 has a flat surface 92 facing oppositely to the mounting surface 18. A pin 94 projects in cantilever fashion from the surface 92. The pin 94 may fit into a pedestal 96 which is fixed to a stationary support 98 to normally situate the camera 14 in a ready position for the prospective customer. The body 16 can be locked to the pedestal 96 as shown in U.S. Pat. No. 5,341,124 or can be freely removable therefrom to allow the camera 14 to be picked up, repositioned freely, and operated. In the latter case, the cord 70 serves as a mechanical restraint to limit the distance that the camera 14 can be moved away from the support 98.

In a preferred form, the body 16 is made from metal. For integrity purposes, one piece can be formed to define both the mounting surface 18 and the oppositely facing surface 92. The body 16 can be made hollow or made from a solid piece with material removed as required to accommodate the mounting bolt 34, the connector 62, and the cord 52.

Figure 5:
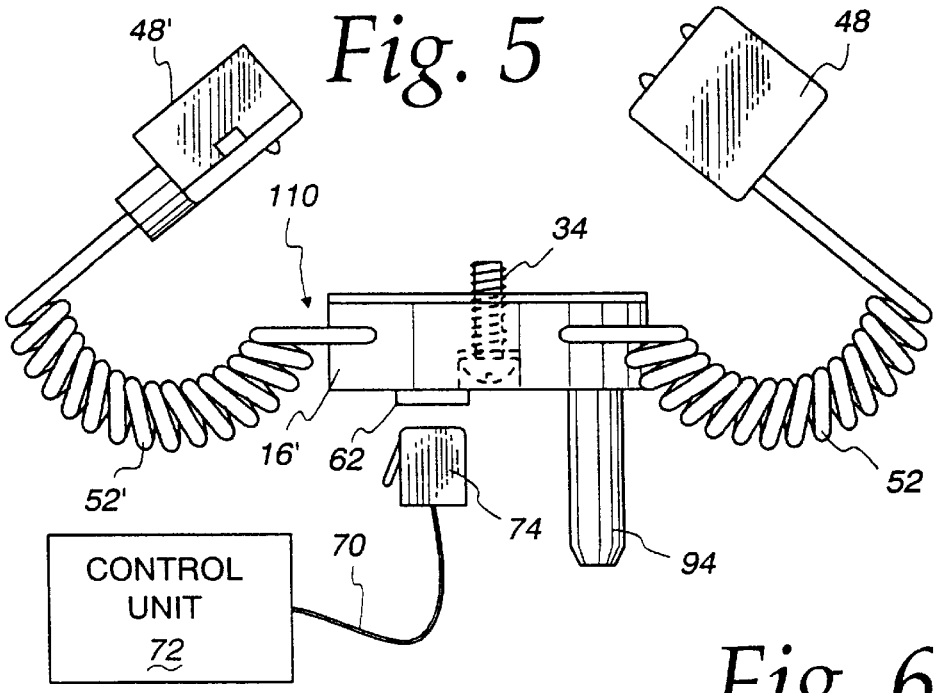
FIG. 5 is a partially schematic representation of a monitoring system showing a side elevation view of a modified form of monitoring assembly according to the present invention.
Figure 11:
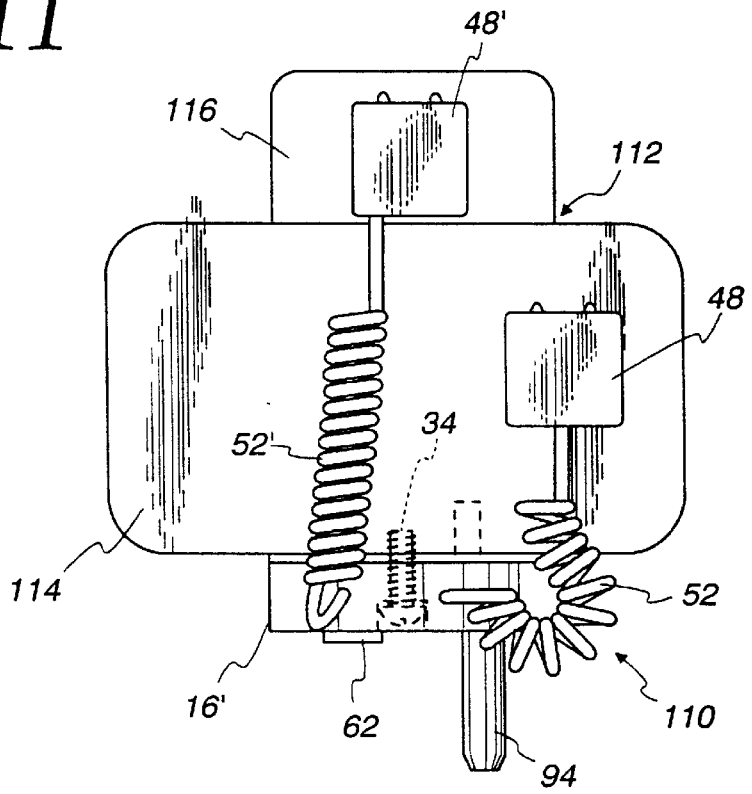
FIG. 11 is a schematic, side elevation view of a modified form of monitoring assembly, according to the present invention, operatively connected to an article to be monitored.
Figure 6:
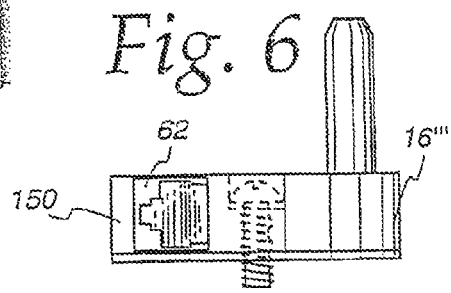

In FIGS. 5 and 11, a modified form of monitoring assembly, according to the present invention, is shown at 110. The monitoring assembly 110 has a body 16' with substantially the same configuration as the body 16. The body 16' has the female connector 62 attached thereto to electrically connect to the sensor 48 through the cord 52. The body 16 is attached to the article to be monitored through the bolt 34.

The principal difference between the monitoring assembly 110 and the monitoring assembly 10 is that the monitoring assembly 110 includes an additional sensor 48' connected both electrically and mechanically to the body 16' through a cord 52'. The sensor 48' and cord 52' may have the same construction as the sensor 48 and cord 52. The conductors in the cord 52' are electrically connected to the control unit 72 through the connectors 62, 74 and cord 70.

The monitoring assembly 110 is particularly adaptable to an article as shown at 112 in FIG. 11 consisting of joined and separable first and second elements 114, 116. As an example, the article 112 may be a camera with the first element 114 being the body of the camera and the second element 116 being a removable lens. With the dual sensor 48, 48' arrangement, through the single body 16', separate monitoring of the body 114 and lens 116 can be carried out. If simply the camera body 114 were monitored, the lens 116, which is potentially quite valuable, could be removed without detection by the system.

Figure 10:
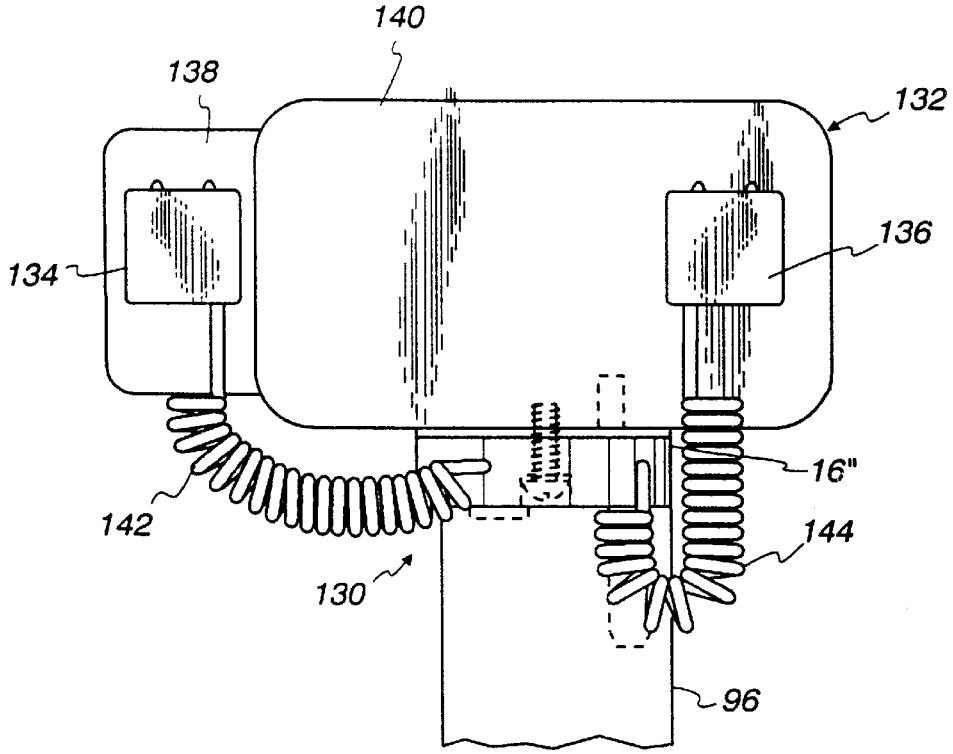
FIG. 10 is a schematic, side elevation view of the monitoring assembly in FIG. 5 operatively connected to an article and supported on a pedestal.

In FIG. 10, a modified form of monitoring assembly, according to the present invention, is shown at 130. The monitoring assembly 130 consists of a body 16" which car be attached to an article 132 in the same manner a attached, as previously described. The body 16" is supportable on the pedestal 96.

The mounting assembly 130 has two sensors 134, 136 which are mechanically fixed to first and second separable elements 138, 140 defining the article 132. The sensors 134, 136 are mechanically coupled to the body 16" through cords 142, 144, respectively. In this version, the monitoring is strictly a mechanical monitoring. That is, the cords 142, 144 are made from wire cable that may be hardened. The security system is as effective as is the tenacity of the engagement between the sensors 134, 136 and the article 132 and the integrity of the cords 142, 144. Details of suitable mechanical parts and connectors are described in U.S. Pat. No. 5,421,667, incorporated herein by reference.

It should be understood that the invention also contemplates the combination of both mechanical and electrical monitoring. That is, either of the sensors 134, 136 could be an electrical sensor as previously described and connected to the aforementioned control unit 72.

Figure 6:
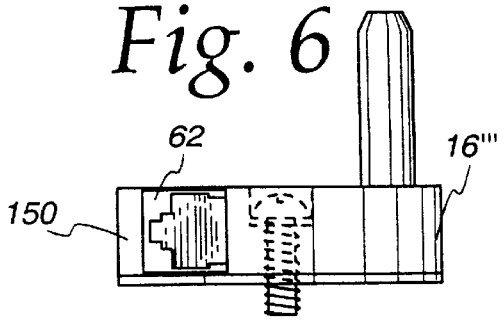
FIG. 6 is a side elevation view of a modified form of body useable with the monitoring assemblies in FIGS. 1 and 5.

In FIG. 6, a further modified form of body 16"' is disclosed. The body 16"' differs from the bodies 16, 16', 16" previously described primarily by reason of the connector 62 being mounted through the peripheral wall 150 of the body 16"' so that the connector 74 is coupled thereto by radial movement of the connector 74 relative to the connector 62. The particular application will dictate the preferred location of the connector 62.

Figure 9:
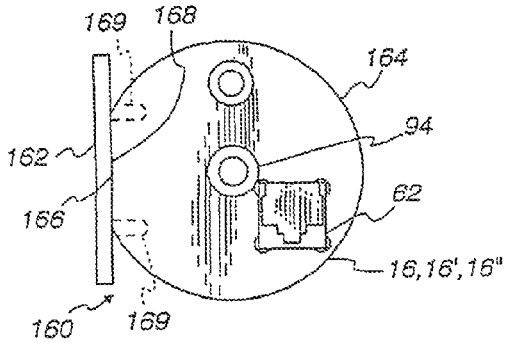
FIG. 9 is bottom view of the body in FIGS. 7 and 8.

In FIGS. 7–9, a further modified form of monitoring assembly, according to the present invention, is shown at 160. The monitoring assembly 160 has a modified body which includes a generally flat wall 162 which attaches to the peripheral wall 164 on the aforementioned body 16, 16', 16". To effect this connection, a flat surface 166 may be firmed on the peripheral wall 164 to allow flush engagement with a mounting surface 168 on the wall 162. Screws 169 maintain the wall 162 in assembled relationship.

With this arrangement the planes of the mounting surface 168 on the wall 162 and the mounting surface 18 are at right angles to each other to cooperatively define a seat, for in this case a relatively thin profile camera 170. In the absence of this separate wall 162, the camera 170 would have to be attached along the narrow peripheral edge 172 thereof. Alternatively, one of the large area oppositely facing flat surfaces 174, 176 would have to be bonded to the body surface 18, which would potentially interfere with testing of the camera 170 by a user.

The sensor 48 is attached to the camera 170 and operates in the same manner as previously described. This version also contemplates that the multiple sensors can be used and that the sensors can either be mechanical, electrical, or a combination thereof.

The foregoing disclosure of specific embodiments is intended to be illustrative of the broad concepts comprehended by the invention.

We claim:

1. In combination:

a portable article to be monitored;

a body which is rigidly attached to the portable article to be monitored, said body being substantially smaller than the portable article to be monitored;

a first sensor having a secured state and an unsecured state and capable of being attached to an article to be monitored, the first sensor having a housing; and a first elongate cord extending between the first sensor and body and having first and second separate conductors and a) mechanically connecting the first sensor to the body and b) defining a conductive path through both the first and second conductors between the first sensor and the body, the first and second conductors each being attached to the housing so as to be in fixed relationship to each other both with the first sensor fully separated from a portable article to be monitored and attached to a portable article to be monitored, the first sensor being in the unsecured state with the conductive path between the first sensor and the body interrupted.

2. The combination according to claim 1 further comprising a bolt which extends through the body and into the article to be monitored to attach the body to the article to be monitored.

3. The combination according to claim 2 wherein the body has a substantially flat mounting surface and there is an opening extending through the flat mounting surface to accept the mounting bolt.

4. The combination according to claim 3 wherein the body has a second surface that is substantially flat and faces oppositely to the flat mounting surface and both the mounting and second surfaces are formed from a single piece.

5. The combination according to claim 1 further comprising a mounting pin fixedly attached to the body and projecting in cantilever fashion from the body.

6. The combination according to claim 1 wherein there is a light emitting element on the housing which is illuminated with the first sensor in at least one of the secured and unsecured states.

7. The combination according to claim 1 wherein the first sensor has a switch on the housing that is changeable between a first state and a second state, the first sensor changing from the secured state into the unsecured state as an incident of the switch changing from the first state into the second state, the housing on the first sensor has a wall which is capable of being operatively attached to a first element to be monitored and with the wall operatively attached to a first element to be monitored the switch is maintained in the first state.

8. The combination according to claim 1 further comprising a second sensor having a secured state and an unsecured state and capable of being attached to an article to be monitored, and a second elongate cord extending between the second sensor and body and having at least one conductor and a) mechanically connecting the second sensor to the body and b) defining a conductive path between the second sensor and the body, the second sensor being in the unsecured state for the second sensor with the conductive path between the second sensor and the body interrupted.

9. The combination according to claim 1 wherein the body comprises first and second substantially flat, transverse surfaces and each of the flat surfaces abuts to the article to be monitored.

10. The combination according to claim 1 further comprising an alarm which is activated in response to the first sensor changing from the secured state into the unsecured state and the portable article being monitored can be moved independently of the alarm.

11. The combination according to claim 10 further comprising a control unit which senses changing of the first sensor from the secured state to the unsecured state and as an incident thereof causes the alarm to be activated and the portable article can be moved independently of the control unit.

12. A monitoring assembly comprising:

a body which is capable of being attached to an article to be monitored;

a first sensor having a secured state and an unsecured state and capable of being attached to an article to be monitored;

a first elongate cord extending between the first sensor and body and having at least one conductor and a) mechanically connecting the first sensor to the body and b) defining a conductive path between the first sensor and the body, the first sensor being in the unsecured state with the conductive path between the first sensor and the body interrupted; and a connector on the body capable of releasably connecting to a connector on a second elongate cord to allow the second elongate cord to establish a conductive path between the at least one conductor and a control unit for monitoring the state of the first sensor.

13. The monitoring assembly according to claim 12 wherein the connector on the body comprises a phone jack.

14. A monitoring assembly comprising:

a body which is capable of being attached to an article to be monitored;

a first sensor having a secured state and an unsecured state and capable of being attached to an article to be monitored;

a first elongate cord extending between the first sensor and body and having at least one conductor and a) mechanically connecting the first sensor to the body and b) defining a conductive path between the first sensor and the body, the first sensor being in the unsecured state with the conductive path between the first sensor and the body interrupted; and a second elongate cord and cooperating connectors on the body and second elongate cord which can be coupled by press fitting to establish a conductive path through the second cord between the at least one conductor and a control unit for monitoring the state of the first sensor.

15. A monitoring assembly comprising:

a body which is capable of being attached to an article to be monitored;

a first sensor having a secured state and an unsecured state and capable of being attached to an article to be monitored; and a first elongate cord extending between the first sensor and body and having at least one conductor and a) mechanically connecting the first sensor to the body and b) defining a conductive path between the first sensor and the body, the first sensor being in the unsecured state with the conductive path between the first sensor and the body interrupted, wherein the body defines first and second substantially flat transverse mounting surfaces for an article to be monitored.

16. In combination:

a) an article to be monitored; and b) a monitoring assembly, said monitoring assembly comprising:

a body;

a fastener rigidly attaching the body to the article so that the body and fastener are movable as one piece, the body being substantially smaller than the article to be monitored;

a first sensor having a secured state and an unsecured state and attached to the article; and a first elongate cord extending from the first sensor and connected directly to the body and having at least one conductor and a) mechanically connecting the first sensor to the body and b) defining a conductive path between the first sensor and the body, the first sensor being in the unsecured state with the conductive path between the first sensor and the body interrupted, wherein the first sensor has a switch with a movable element thereon that is changeable between a first state and a second state, the first sensor changing from the secured state into the unsecured state as an incident of the switch changing from the first state into the second state, and the first sensor has a wall which is attached to the article so that the first sensor wall and article cooperatively maintain the switch in the first state, the switch changing from the first state into the second state as an incident of the first sensor wall being separated from the article and the movable element moving from the first state into the second state.

17. The combination according to claim 16 wherein the fastener is a bolt that extends through the body and into the article.

18. The combination according to claim 16 wherein the article comprises first and second separable elements, the monitoring assembly further comprises a second sensor having a secured state and an unsecured state, and a second elongate cord extending between the second sensor and body and having at least one conductor and a) mechanically connecting the second sensor to the body and b) defining a conductive path between the second sensor and the body, the second sensor being in the unsecured state from the second sensor with the conductive path between the second sensor and the body interrupted, the first sensor is attached to the first element and the second sensor is attached to the second element.

19. The combination according to claim 16 wherein there is a light emitting element on at least one of the first sensor and body which is illuminated with the first sensor in one of the secured and unsecured states.

20. The combination according to claim 16 wherein the article comprises a camera.

21. In combination:

a) an article to be monitored; and b) a monitoring assembly, said monitoring assembly comprising:

a body;

a fastener rigidly attaching the body to the article;

a first sensor having a secured state and an unsecured state and attached to the article; and a first elongate cord extending between the first sensor and body and having at least one conductor and a) mechanically connecting the first sensor to the body and b) defining a conductive path between the first sensor and the body, the first sensor being in the unsecured state with the conductive path between the first sensor and the body interrupted, wherein the monitoring assembly comprises a second elongate cord, and there are cooperating connectors on the body and second elongate cord which can be coupled to establish a conductive path through the second cord between the at least one conductor and a control unit for monitoring the state of the first sensor with the body rigidly attached to the article.

22. The combination according to claim 21 wherein the cooperating connectors are configured to be coupled by a press fit operation.

23. In combination:

a) an article to be monitored; and b) a monitoring assembly, said monitoring assembly comprising:

a body;

a fastener rigidly attaching the body to the article;

a first sensor having a secured state and an unsecured state and attached to the article; and a first elongate cord extending between the first sensor and body and having at least one conductor and a) mechanically connecting the first sensor to the body and b) defining a conductive path between the first sensor and the body, the first sensor being in the unsecured state with the conductive path between the first sensor and the body interrupted, wherein the body comprises first and second substantially flat, transverse surfaces and each of the flat surfaces is attached to the article.

24. In combination:

a) an article to be monitored; and b) a monitoring assembly, said monitoring assembly comprising:

a body;

a fastener rigidly attaching the body to the article;

a first sensor having a secured state and an unsecured state and attached to the article; and a first elongate cord extending between the first sensor and body and having at least one conductor and a) mechanically connecting the first sensor to the body and b) defining a conductive path between the first sensor and the body, the first sensor being in the unsecured state with the conductive path between the first sensor and the body interrupted, wherein the monitoring assembly further comprises a second elongate cord, the combination further comprising a control unit for monitoring the state of the first sensor, and the second elongate cord comprises at least one conductor for establishing a conductive path between the body and the control unit.

25. In combination:

a portable article to be monitored and having at least two elements that are separable, each from the other;

a body which is rigidly attached to the portable article to be monitored, said body being substantially smaller than the article to be monitored;

a first sensor having a secured state and an unsecured state and capable of being attached to an article to be monitored;

a first elongate cord extending between the first sensor and body and having at least one conductor and a) mechanically connecting the first sensor to the body and b) defining a conductive path between the first sensor and the body, the first sensor being in the unsecured state with the conductive path between the first sensor and the body interrupted; and an alarm which is activated in response to the first sensor changing from the secured state into the unsecured state, wherein the portable article to be monitored is movable independently of the alarm.

26. The combination according to claim 25 wherein there is a second elongate cord for electrically connecting between the alarm and the first sensor.

* * * * *

US005861807C1

(12) EX PARTE REEXAMINATION CERTIFICATE (9701st)

United States Patent
Leyden et al.

(10) Number: US 5,861,807 C1
(45) Certificate Issued: Jun. 10, 2013

(54) SECURITY SYSTEM

(75) Inventors: Roger J. Leyden, Willow Springs, IL (US); Michael A. Parent, Palatine, IL (US)

(73) Assignee: Se-Kure Controls, Inc., Franklin Park, IL (US)

Reexamination Request:
No. 90/009,635, Nov. 9, 2009
No. 90/011,404, Feb. 4, 2011

Reexamination Certificate for:

| | |
|---|---|
| Patent No.: | **5,861,807** |
| Issued: | **Jan. 19, 1999** |
| Appl. No.: | **08/967,729** |
| Filed: | **Nov. 12, 1997** |

(51) Int. Cl.
*G08B 13/14* (2006.01)

(52) U.S. Cl.
USPC ..... 340/568.2; 340/568.4; 340/572.8; 340/687

(58) Field of Classification Search
None
See application file for complete search history.

(56) References Cited

To view the complete listing of prior art documents cited during the proceedings for Reexamination Control Numbers 90/009,635 and 90/011,404, please refer to the USPTO's public Patent Application Information Retrieval (PAIR) system under the Display References tab.

*Primary Examiner* — Christina Y Leung

(57) ABSTRACT

A monitoring assembly has a body which is capable of being attached to an article to be monitored, a first sensor having a secured state and an unsecured state and capable of being attached to an article to be monitored, and a first elongate cord extending between the first sensor and body and having at least one conductor and a) mechanically connecting the first sensor to the body and b) defining a conductive path between the first sensor and the body. The first sensor is in the unsecured state with the conductive path between the first sensor and the body interrupted.

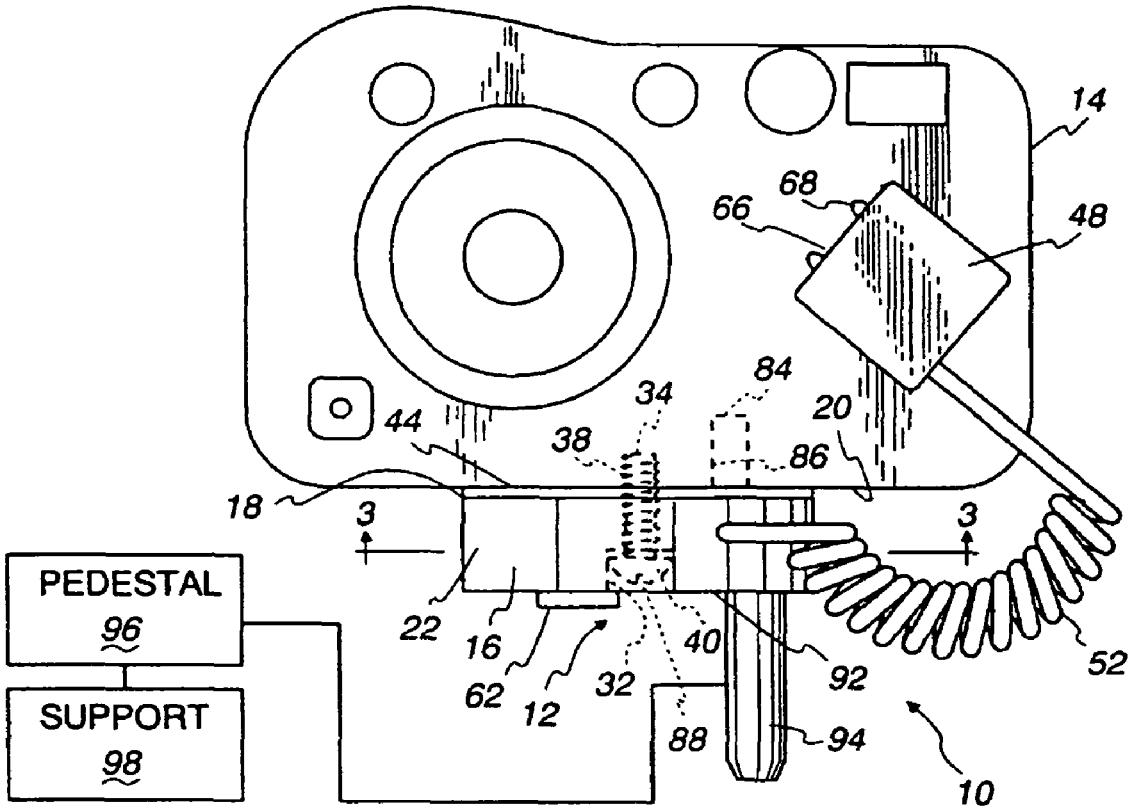

Figure 4:
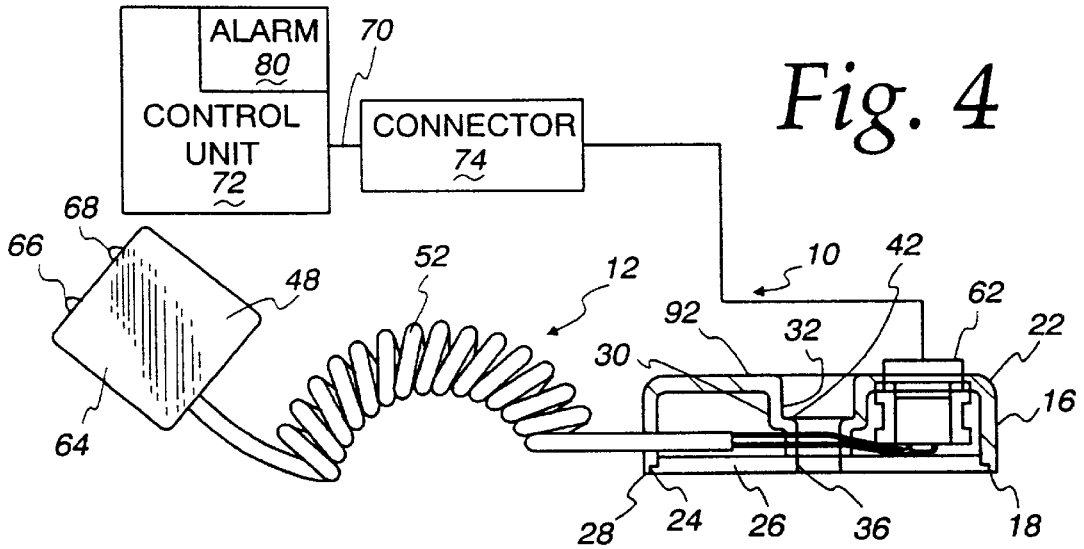
FIG. 4 is a partially schematic representation of the monitoring system of FIG. 1 and showing an enlarged, cross-sectional view of the body taken along line 4—4 of FIG. 3 with a cord and sensor operatively connected thereto.

Amended
Fig. 4
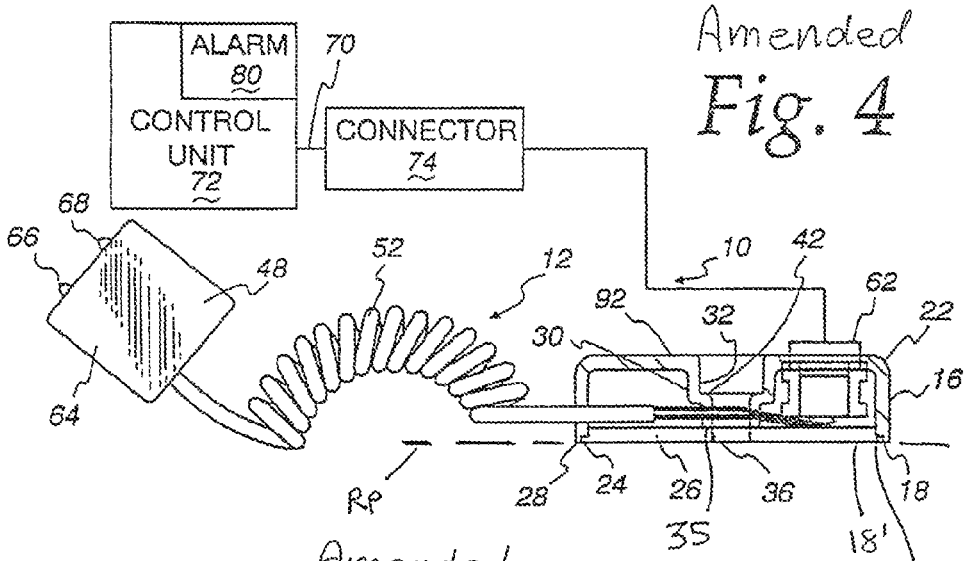
Amended
Fig. 5
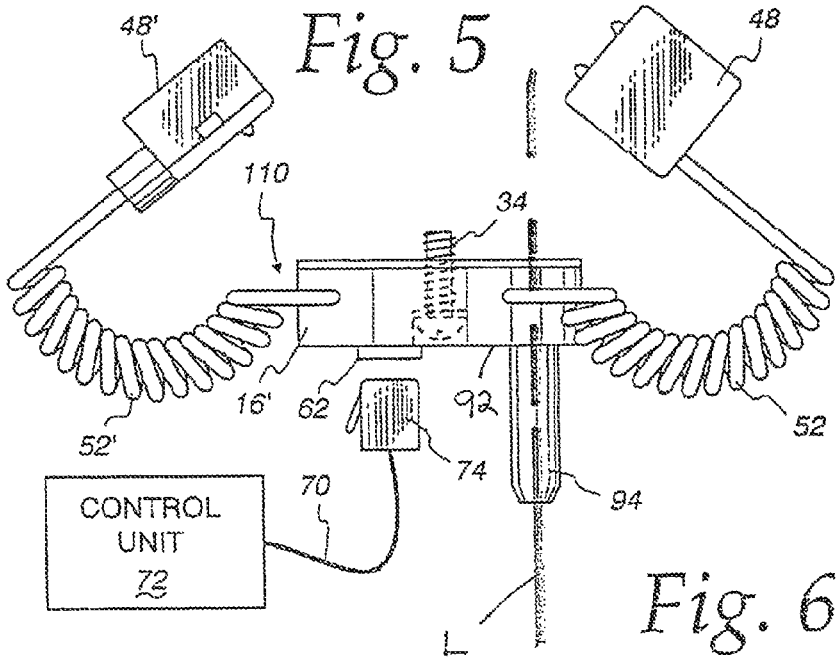

Amended
Fig. 7
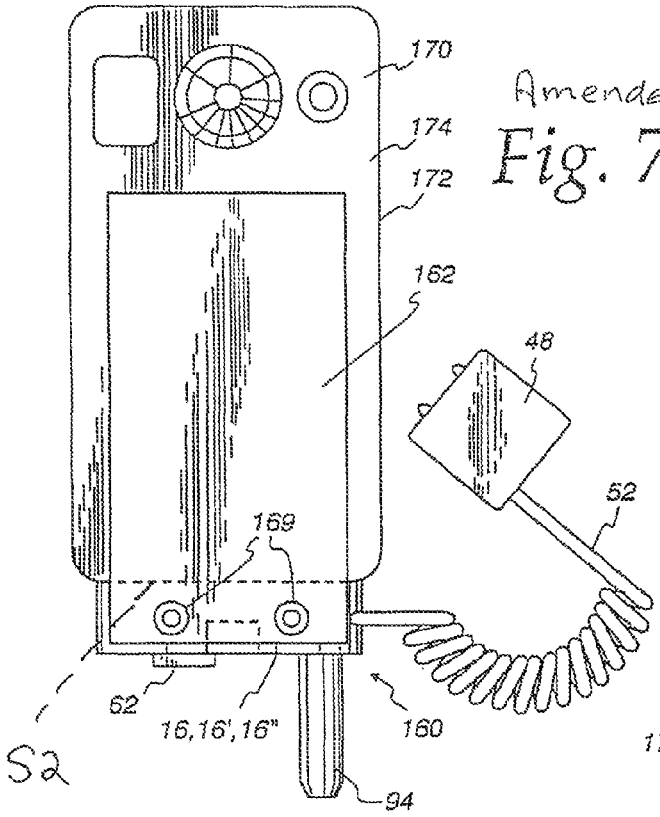
Amended
Fig. 8
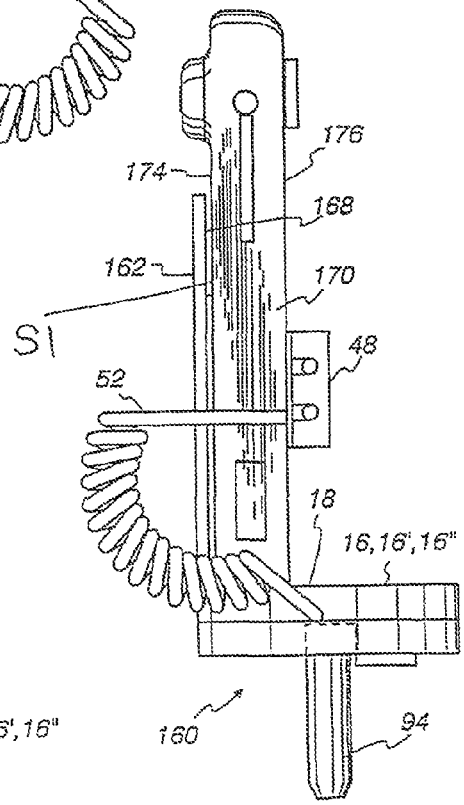

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, line 66-Column 4, line 8:

The mounting assembly 12 consists of a disk-shaped body 16 having a flat mounting surface 18 which can be facially abutted to a flat surface 20 on the bottom of the camera 14. In this particular embodiment, the body 16 has a cup-shaped portion 22 with a stepped, outer rim 24 *with a surface 25* which seats a flat disk 26 that defines the mounting surface 18 in conjunction with an outer edge 28 of the rim 24. A central boss 30 defines a stepped through bore 32 to accept a mounting bolt 34 *and terminates at an annular edge 35*. A bore 36 in the disk 26 is coaxial with the through bore 32. *As seen in FIG. 4, with the body 16 unattached to an article, the flat disk 26 abuts simultaneously to the commonly facing surface 25 and annular edge 35 whereby an exposed flat surface 18' on the flat disk 26, defining a part of the mounting surface 18, resides in a reference plane RP together with the outer edge 28 of the rim 24.*

*Thus, the coplanar surface 18' and surface 25 are abuttable simultaneously to a flat surface on an article to be monitored. The mounting surface 18' is supported in a planar shape within the reference plane RP by the surface 25 and annular edge 35 respectively at a perimeter region of the body 16 and at a central region thereof.*

Column 5, lines 20-30:

The body 16 has a flat surface 92 facing oppositely to the mounting surface 18. A pin 94 projects in cantilever fashion from the surface 92 *in a line L extending through the mounting surface 18. The connector 62 is at the surface 92 so that the connector 74 is press fit to the connector through the surface 92.* The pin 94 *remains exposed with the body attached to the camera and* may fit into a pedestal 96 which is fixed to a stationary support 98 to normally situate the camera 14 in a ready position for the prospective customer. The body 16 can be locked to the pedestal 96 as shown in U.S. Pat. No. 5,341,124 or can be freely removable therefrom to allow the camera 14 to be picked up, repositioned freely, and operated. In the latter case, the cord 70 serves as a mechanical restraint to limit the distance that the camera 14 can be moved away from the support 98.

In Column 6, lines 39-48: below:

With this arrangement the planes of the mounting surface 168 on the wall 162 and the mounting surface 18 are at right angles to each other to cooperatively define a seat, for in this case a relatively thin profile camera 170. *The mounting surfaces 168, 18 are attached, one each, to exposed surfaces S1, S2 on the camera 170. The surfaces S1, S2 are transverse, each to the other, to facially engage the mounting surfaces 168, 18.* In the absence of this separate wall 162, the camera 170 would have to be attached along the narrow peripheral edge 172 thereof. Alternatively, one of the large area oppositely facing flat surfaces 174, 176 would have to be bonded to the body surface 18, which would potentially interfere with testing of the camera 170 by a user.

THE DRAWINGS FIGURES HAVE BEEN CHANGED AS FOLLOWS:

On FIG. 4: Reference Nos. 18', 25 and 35, and line RP added. FIG. 5: Reference No. 92 and line L added. FIG. 7: Reference No. S2 added. FIG. 8: Reference No. S1 added.

AS A RESULT OF REEXAMINATION, IT HAS BEEN DETERMINED THAT:

The patentability of claims 21-23 is confirmed.

Claims 1-8, 10-14, 16-20 and 24-26 are cancelled.

Claims 9 and 15 are determined to be patentable as amended.

New claims 27-64 are added and determined to be patentable.

9. [The] *In* combination [according to claim 1]*:*

*a portable article to be monitored;*

*a body which is rigidly attached to the portable article to be monitored, said body being substantially smaller than the portable article to be monitored;*

*a first sensor having a secured state and an unsecured state and capable of being attached to an article to be monitored,*

*the first sensor having a housing; and*

*a first elongate cord extending between the first sensor and body and having first and second separate conductors and a) mechanically connecting the first sensor to the body and b) defining a conductive path through both the first and second conductors between the first sensor and the body,*

*the first and second conductors each being attached to the housing so as to be in fixed relationship to each other both with the first sensor fully separated from a portable article to be monitored and attached to a portable article to be monitored,*

*the first sensor being in the unsecured state with the conductive path between the first sensor and the body interrupted,* wherein the body comprises first and second substantially flat, transverse surfaces and each of the flat surfaces abuts to the article to be monitored.

15. A monitoring assembly *for an article having two exposed transverse surfaces, the monitoring assembly* comprising:

a body which is capable of being attached to [an] *the* article [to be monitored];

a first sensor having a secured state and an unsecured state and capable of being attached to [an] *the* article [to be monitored]; and a first elongate cord extending between the first sensor and body and having at least one conductor and a) mechanically connecting the first sensor to the body and b) defining a conductive path between the first sensor and the body, the first sensor being in the unsecured state with the conductive path between the first sensor and the body interrupted, wherein the body defines first and second substantially flat transverse mounting surfaces [for an article to be monitored] *and with the first mounting surface attached to one of the two exposed surfaces on the article the second mounting surface abuts to the other of the two exposed surfaces.*

*27. The combination according to claim 1 wherein there is a mounting surface on the body that is supported in a planar shape by the body at each of: a) a central region of the body; and b) a perimeter region of the body so that the mounting surface facially engages a flat surface on the portable article at the central region of the body and the perimeter region of the body with the body rigidly attached to the portable article to be monitored.*

*28. The combination according to claim 27 further comprising a flat element that defines at least a part of the mounting surface and is attached to the body.*

*29. The combination according to claim 28 wherein the body comprises a stepped outer rim with a surface facing the same direction as the mounting surface and supporting the flat element.*

*30. The combination according to claim 29 wherein the body comprises an edge, spaced from the outer rim surface, that supports the flat element.*

*31. The combination according to claim 30 further comprising a mounting bolt that extends through the body and into the article to be monitored to attach the body to the article to be monitored and the edge on the body is an annular edge that extends around the mounting bolt.*

*32. A monitoring assembly comprising,*

*a body which is capable of being attached to an article to be monitored;*

*a first sensor having a secured state and an unsecured state and capable of being attached to an article to be monitored;*

*a first elongate cord extending between the first sensor and body and having at least one conductor and a) mechanically connecting the first sensor to the body and b) defining a conductive path between the first sensor and the body,*

*the first sensor being in the unsecured state with the conductive path between the first sensor and the body interrupted;*

*a connector on the body capable of releasably connecting to a connector on a second elongate cord to allow the second elongate cord to establish a conductive path between the at least one conductor and a control unit for monitoring the state of the first sensor; and*

*a mounting pin projecting in cantilever fashion from the body.*

*33. A monitoring assembly comprising:*

*a body which is capable of being attached to an article to be monitored;*

*a first sensor having a secured state and an unsecured state and capable of being attached to an article to be monitored;*

*a first elongate cord extending between the first sensor and body and having at least one conductor and a) mechanically connecting the first sensor to the body and b) defining a conductive path between the first sensor and the body,*

*the first sensor being in the unsecured state with the conductive path between the first sensor and the body interrupted;*

*a connector on the body capable of releasably connecting to a connector on a second elongate cord to allow the second elongate cord to establish a conductive path between the at least one conductor and a control unit for monitoring the state of the first sensor,*

*wherein the body has a mounting surface to engage an article to be monitored with the body attached to the article to be monitored, and an oppositely facing second surface and the connector on the body is at the second surface; and*

*a mounting pin projecting in cantilever fashion from the second surface.*

*34. A monitoring assembly comprising:*

*a body which is capable of being attached to an article to be monitored,*

*a first sensor having a secured state and an unsecured state and capable of being attached to an article to be monitored;*

*a first elongate cord extending between the first sensor and body and having at least one conductor and a) mechanically connecting the first sensor to the body, and b) defining a conductive path between the first sensor and the body,*

*the first sensor being in the unsecured state with the conductive path between the first sensor and the body interrupted;*

*a second elongate cord and cooperating connectors on the body and second elongate cord which can be coupled by press fitting to establish a conductive path through the second cord between the at least one conductor and a control unit for monitoring the state of the first sensor; and*

*a mounting pin projecting in cantilever fashion from the body.*

*35. A monitoring assembly comprising:*

*a body which is capable of being attached to an article to be monitored;*

*a first sensor having a secured state and an unsecured state and capable of being attached to an article to be monitored;*

*a first elongate cord extending between the first sensor and body and having at least one conductor and a) mechanically connecting the first sensor to the body and b) defining a conductive path between the first sensor and the body,*

*the first sensor being in the unsecured state with the conductive path between the first sensor and the body interrupted; and*

*a second elongate cord and cooperating connectors on the body and second elongate cord which can be coupled by press fitting to establish a conductive path through the second cord between the at least one conductor and a control unit for monitoring the state of the first sensor,*

*wherein the body has a mounting surface, to engage an article to be monitored with the body attached to the article to be monitored, and an oppositely facing second surface and the cooperating connector on the body is at the second surface,*

*wherein the monitoring assembly further comprises a mounting pin projecting in cantilever fashion from the second surface.*

*36. The combination according to claim 16 wherein there is a mounting surface on the body that is supported in a planar shape by the body at each of: a) a central region of the body; and b) a perimeter region of the body so that the mounting surface facially engages a flat surface on the portable article*

*at the central region of the body and the perimeter region of the body with the body rigidly attached to the portable article to be monitored.*

*37. The combination according to claim 36 further comprising a flat element that defines at least a part of the mounting surface and is attached to the body.*

*38. The combination according to claim 37 wherein the body comprises a stepped outer rim with a surface facing the same direction as the mounting surface and supporting the flat element.*

*39. The combination according to claim 38 wherein the body comprises an edge, spaced from the outer rim surface, that supports the flat element.*

*40. The combination according to claim 39 further comprising a mounting bolt that extends through the body and into the article to be monitored to attach the body to the article to be monitored and the edge on the body is an annular edge that extends around the mounting bolt.*

*41. The combination according to claim 21 wherein there is a mounting surface on the body that is supported in a planar shape by the body at each of: a) a central region of the body: and b) a perimeter region of the body to facially engage a flat surface on the portable article.*

*42. The combination according to claim 41 further comprising a flat element that defines at least a part of the mounting surface and is attached to the body.*

*43. The combination according to claim 42 wherein the body comprises a stepped outer rim with a surface facing the same direction as the mounting surface and supporting the flat element.*

*44. The combination according to claim 43 wherein the body comprises an edge, spaced from the outer rim surface, that supports the flat element.*

*45. The combination according to claim 44 further comprising a mounting bolt that extends through the body and into the article to be monitored to attach the body to the article to be monitored and the edge on the body is an annular edge that extends around the mounting bolt.*

*46. The combination according to claim 21 further comprising a mounting pin that remains exposed with the body rigidly attached to the article for cooperating with a pedestal for supporting the body.*

*47. The combination according to claim 46 wherein the body comprises a mounting surface to engage the article to be monitored with the body rigidly attached to the article and an oppositely facing second surface and the mounting pin projects from the second surface.*

*48. The combination according to claim 47 wherein the mounting pin is cantilever mounted and projects in a line extending through the mounting surface.*

*49. The combination according to claim 48 in combination with a pedestal into which the pin projects to at least one of: a) lock the body to the pedestal; and b) situate the portable article in a ready position from which the portable article can be moved.*

*50. The combination according to claim 21 wherein the body has a mounting surface, that engages the article to be monitored with the body rigidly attached to the article to be monitored, and an oppositely facing second surface and the cooperating connector on the body is on the second surface.*

*51. The combination according to claim 50 further comprising a mounting pin projecting in cantilever fashion from the body.*

*52. The combination according to claim 51 further comprising a mounting pin projecting in cantilever fashion from the second surface.*

*53. The combination according to claim 24 wherein there is a mounting surface on the body that is supported in a planar shape by the body at each of: a) a central region of the body; and b) a perimeter region of the body so that the mounting surface facially engages a flat surface on the portable article at the central region of the body and the perimeter region of the body with the body rigidly attached to the portable article to be monitored.*

*54. The combination according to claim 53 further comprising a flat element that defines at least a part of the mounting surface and is attached to the body.*

*55. The combination according to claim 54 wherein the body comprises a stepped outer rim with a surface facing the same direction as the mounting surface and supporting the flat element.*

*56. The combination according to claim 55 wherein the body comprises an edge, spaced from the outer rim surface, that supports the flat element.*

*57. The combination according to claim 56 further comprising a mounting bolt that extends through the body and into the article to be monitored to attach the body to the article to be monitored and the edge on the body is an annular edge that extends around the mounting bolt.*

*58. The combination according to claim 25 wherein there is a mounting surface on the body that is supported in a planar shape by the body at each of: a) a central region of the body; and b) a perimeter region of the body so that the mounting surface facially engages a flat surface on the portable article at the central region of the body and the perimeter region of the body with the body rigidly attached to the portable article to be monitored.*

*59. The combination according to claim 58 further comprising a flat element that defines at least a part of the mounting surface and is attached to the body.*

*60. The combination according to claim 59 wherein the body comprises a stepped outer rim with a surface facing the same direction as the mounting surface and supporting the flat element.*

*61. The combination according to claim 60 wherein the body comprises an edge, spaced from the outer rim surface, that supports the flat element.*

*62. The combination according to claim 61 further comprising a mounting bolt that extends through the body and into the article to be monitored to attach the body to the article to be monitored and the edge on the body is an annular edge that extends around the mounting bolt.*

*63. A monitoring assembly comprising:*

*a body which is capable of being attached to an article to be monitored;*

*a first sensor haying a secured state and an unsecured state and capable of being attached to an article to be monitored;*

*a first elongate cord extending between the first sensor and body and having at least one conductor and a) mechanically connecting the first sensor to the body and b) defining a conductive path between the first sensor and the body,*

*the first sensor being in the unsecured state with the conductive path between the first sensor and the body interrupted; and*

*a connector on the body capable of releasably connecting to a connector on a second elongate cord to allow the second elongate cord to establish a conductive path between the at least one conductor and a control unit for monitoring the state of the first sensor,*

*wherein the body is configured to be fixedly attached to an article to be monitored.*

*64. A monitoring assembly comprising:*

*a body which is capable of being attached to an article to be monitored;*

*a first sensor having a secured state and an unsecured state and capable of being attached to an article to be monitored;*

*a first elongate cord extending between the first sensor and body and having at least one conductor and a) mechanically connecting the first sensor to the body and b) defining a conductive path between the first sensor and the body,*

*the first sensor being in the unsecured state with the conductive path between the first sensor and the body interrupted; and*

*a connector on the body capable of releasably connecting to a connector on a second elongate cord to allow the second elongate cord to establish a conductive path between the at least one conductor and a control unit for monitoring the state of the first sensor,*

*wherein the body is configured to be directly attached to an article to be monitored independently of the first sensor.*

* * * * *